US006903256B2

(12) United States Patent
Pittman et al.

(10) Patent No.: US 6,903,256 B2
(45) Date of Patent: Jun. 7, 2005

(54) HOLDING EXTENSION FOR ADDING MASS TO GUITAR PICK

(76) Inventors: Richard Aspen Pittman, 13337 Astoria St., Sylmar, CA (US) 91342; Steven L. Fishman, 39 Great Russell Street, London WC1B 3PP (GB)

( * ) Notice: Subject to any disclaimer, the term of this patent is extended or adjusted under 35 U.S.C. 154(b) by 87 days.

(21) Appl. No.: 10/652,313

(22) Filed: Sep. 2, 2003

(65) Prior Publication Data

US 2005/0045020 A1 Mar. 3, 2005

(51) Int. Cl.[7] ..... G10D 3/16

(52) U.S. Cl. ..... 84/322; 84/320; 84/321; 84/329; 84/453; 84/458

(58) Field of Search ..... 84/322, 320, 321, 84/329, 453, 458

(56) References Cited

U.S. PATENT DOCUMENTS 3,735,663 A * 5/1973 Cowell, Sr. ..... 84/322
4,137,814 A * 2/1979 Rowley ..... 84/322
4,497,237 A * 2/1985 Beall ..... 84/322
D291,809 S * 9/1987 Jasper ..... D17/20
4,794,839 A * 1/1989 Adler ..... 84/322
5,973,243 A * 10/1999 Christenson ..... 84/322
6,054,643 A * 4/2000 Chance et al. ..... 84/322
6,242,677 B1 * 6/2001 Sander ..... 84/322

* cited by examiner

*Primary Examiner*—Shih-yung Hsieh
(74) *Attorney, Agent, or Firm*—J. E. McTaggart

(57) ABSTRACT

A pick-handle is attached to the to the "rear" edge of a conventional pick via a metal shaft. The handle portion is made to be comfortably grasped in the palm of the player's hand while the pick is held in the normal manner between the thumb and forefinger. Stringed instrument playing technique is enhanced by improved control over the pick and increased volume capability due to the increased mass effectively transmitted to the pick from the hand, wrist and arm of the player. Additionally, the invention reduces the strain on the thumb and forefinger by allowing the other fingers to supplement the grip, and also reduces the risk of the pick slipping out of playing position or totally escaping from the thumb/finger grasp. Attachment of the pick to the shaft may be implemented by a spring clip that allows easy removal of the pick and replacement by practically any commonly available pick of the player's choice.

9 Claims, 2 Drawing Sheets

HOLDING EXTENSION FOR ADDING MASS TO GUITAR PICK

FIELD OF THE INVENTION

The present invention relates to the field of stringed musical instruments and more particularly it relates to a holding extension for a guitar pick that increases the effective mass of the pick by physically coupling the pick to the player's hand, wrist and arm.

BACKGROUND OF THE INVENTION

Musicians playing stringed instruments such as guitars and banjos typically produce sound by picking the strings with a plastic (or metal) pick held between a thumb and finger. This holding arrangement fails to effectively couple the mass of the player's hand to the pick, and thus places a limit on the loudness available for loud passages, particularly with an acoustic instrument. Furthermore, the continued stress of full dependancy on the thumb/finger grip can be fatiguing, and/or the pick can unintentionally shift to an undesired position or even totally escape the player's grasp and drop, thus degrading and/or interrupting the musical performance, especially when corrective action demands the use of the player's other hand.

DISCUSSION OF KNOWN ART

U.S. Pat. No. 5,973,243 to Christenson for a GUITAR PICK discloses a pick with an extension ring portion that fits over the player' forefinger.

U.S. design Pat. No. 291,809 shows a GUITAR PICK fitted with an attachment band, presumably to encircle a finger or thumb.

U.S. Pat. No. 4,137,814 to Rowley for a NONSLIP GUITAR PICK discloses a pick attached by a flexible connection such as a chain to a palm piece, relying on "transmission of a tensile force between said pick element and said palm piece".

U.S. Pat. No. 4,497,237 to Beall for a GUITAR PICK discloses a pick including a relatively stiff band movably attached to its top edge.

U.S. Pat. No. 6,054,643 to Chance et al for a GUITAR PICK WITH GRIPPING MEANS discloses a pick or pick holder with a curved finger grip portion on one side adapted to form a cradle for engaging either the thumb or index finger.

OBJECTS OF THE INVENTION

It is a primary object of the present invention to provide a holding device for attachment to a guitar pick that will add to the effective mass of the pick by virtue of coupling the pick to the player's hand, wrist and arm.

It is a further object that the holding device will reduce the conventional stress and fatigue caused by full dependancy on thumb-to-finger gripping of the pick.

It is a further object that the holding device will also serve to avoid conventionally experienced slippages and/or loss of the pick due to a momentary relaxation of the thumb-to-finger grip.

It is a further object that the holding device be made easily detachable from the pick and readily attached to another pick.

It is a further object that the holding device be made to attach in a satisfactory manner to popular picks of different thickness.

SUMMARY OF THE INVENTION

The foregoing objects have been met in the present invention of a pick-handle attached to an edge of a conventional pick via a metal shaft. The handle portion is made to be comfortably grasped in the palm of the player's hand while the pick is held in the normal manner between the thumb and forefinger. Stringed instrument playing technique is enhanced by improved control over the pick and increased volume capability due to the increased mass effectively transmitted to the pick from the hand, wrist and arm of the player.

Additionally, the invention improves playing comfort and reduces fatigue by reducing the necessary strong gripping force conventionally required when the thumb and forefinger alone must provide all of the holding force to retain the pick.

Furthermore the inventions reduces the risk of the pick slipping out of playing position or totally escaping from the thumb/finger grasp.

Attachment of the pick to the shaft may be implemented by a spring clip that allows easy removal of the pick and replacement by practically any commonly available pick of the player's choice.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
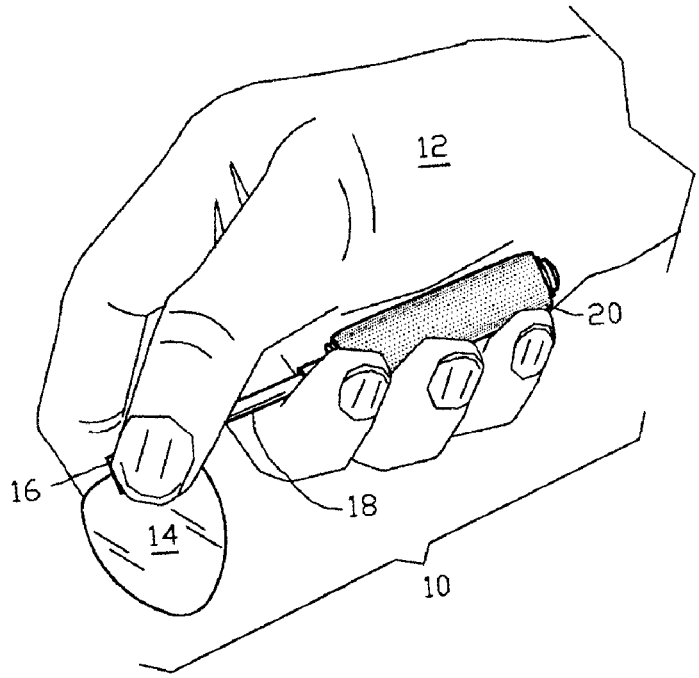
FIG. 1 is a perspective view of a pick and pick-holder in accordance with present invention.

FIG. 1 is a perspective view of a pick-holder 10 holding a pick 12 in accordance with the present invention, as held in the pleyer's hand 12. A conventional pick 14, as utilized commonly in playing stringed musical instruments such as guitars, basses and the like, is retained frictionally by a spring clip 16 which is attached by a shaft portion 18 to a cylindrical handle portion 20. As shown, the pick-holder 10 is held in the player's hand 12 with the pick portion 14 held between the thumb and index finger, very much in the conventional manner of holding a pick for playing a stringed instrument, while the handle portion 20 is held in the palm of the and 12 by the other three fingers.

Figure 2:
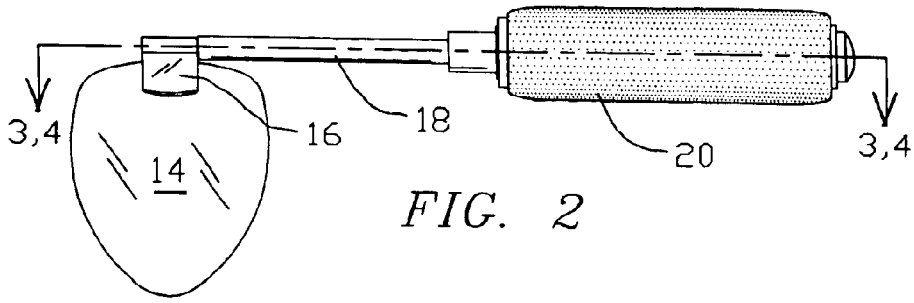
FIG. 2 is a elevational side view of the pick and pack-holder of FIG. 1.

FIG. 2 is an elevational side view of pick-holder of FIG. 1 showing the pick 14, spring clip 16, shaft portion 18 and handle portion 20.

Figure 3:
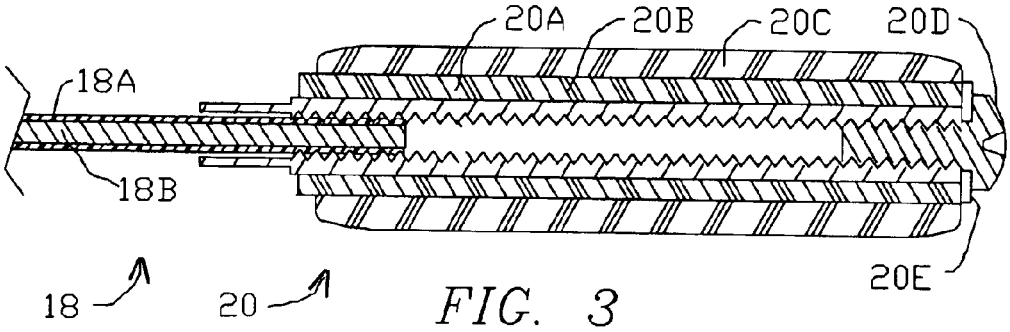
FIG. 3 is an enlarged cross-sectional view of the handle portion taken through axis 3,4—3,4 of FIG. 2.

FIG. 3 is an enlarged (2×) cross-section of the shaft portion 18 and handle portion 20 of the pick-holder 10 taken through axis 3,4—3,4 of FIG. 2. The shaft portion 18 is configured with a rod-shaped metal shaft-core 18A surrounded by a close-fitting non-metallic shaft-sleeve 18B, typically plastic sleeving, e.g. such as used in electrical wiring. The shaft-core 18A is typically made from metal, preferably soft copper or soft iron that, while supplied initially in straight form, can be bent slightly by the player for a more comfortable fit in the palm of the player's hand (12 FIG. 1). In handle portion 20, a metal handle-core 20A has a longitudinal bore that is threaded (typically 6–32).

At the left hand end of handle portion 20, as shown, part of the shaft portion 18 is engaged by the threaded bore of shaft-core 20A, including sleeve 18A which when made from suitable compliant material, can be simply force-threaded into place without requiring pre-threading.

Handle-core 20A is closely surrounded by a tubular non-metallic handle-sleeve, preferably made up from two layer portions as shown: an inner sleeve portion 20B made from relatively solid plastic material such as polystyrene, and an outer sleeve portion 20C made from relatively soft material such as plastic foam, closely surrounding said inner handle-sleeve portion 20B to form the resilient exterior handle configuration. Optionally the core-to-layer and/or the layer-to layer interfaces may be adhesively fastened.

At the right hand end of handle portion 20, a machine screw 20D, threaded into shaft-core 20A, and a flat washer 20E serve to provide a finished aesthetic appearance and to ensure alignment and retention of sleeve portions 20A and 20B on shaft-core 20A.

As an optional feature, handle-core 18A is machined or otherwise formed at the end that engages shaft 16 to provide a short sleeve of reduced diameter extending from the handle portion 18 as shown.

Typically the handle portion 18 is made to be about ½ inch in diameter with a length of 1 to 2 inches. The length of exposed shaft portion 16 including clip 14 is typically made to be within a range from 1⅜ inches to 1¾ inches. Typically the handle-core 18A is made with ¼ inch in diameter, the inner sleeve 18B is made with ⅜ inches outer diameter, the shaft-core 18A is about 1/16 diameter copper wire, and the shaft-sleeve 18B is made about ⅛ inch in outer diameter.

Figure 4:
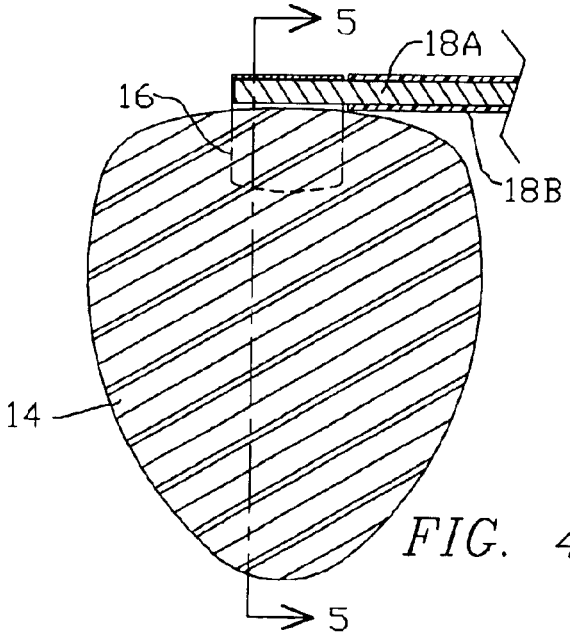
FIG. 4 is an enlarged cross-sectional view of the pick and the clip portion taken through axis 3,4—3,4 of FIG. 2.

FIG. 4 is an enlarged (2×) cross section of the left hand end of shaft portion 18 of FIG. 2, showing the shaft-sleeve 18B extending only to the edge of clip 16 while shaft-core 18A extends through clip 6 to which it is firmly fastened by soldering, welding, adhesively or other effective fastening method. One of the two plates of clip 16 is shown in broken lines as hidden by pick 14.

Figure 5:
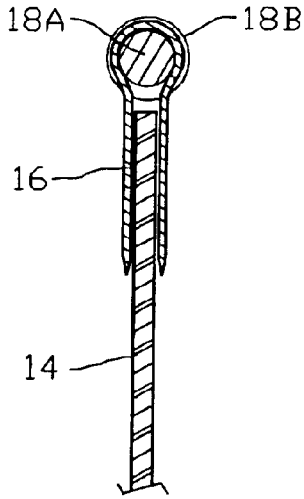
FIG. 5 is a further-enlarged cross-sectional view of an upper portion of the pick, clip and shaft-core taken through axis 5—5 of FIG. 4.

FIG. 5 is a further enlarged (2×2×) cross-sectional view of clip 16, shaft-core 18A and pick 14 taken at axis 5—5 of FIG. 4. Pick 14 is seen retained between the two plates of clip 16 by spring tension provided by the material of clip 16: suitable spring metal such as spring steel or phosphor bronze and preferably nickel-plated. The entry edges are tapered to facilitate attachment.

The particular shape and size of the pick holder 10 may depart from that shown and described above, since it is subject to optimization, and may be made from different materials and in different variations, preferably made in a manner that it can be customized for the individual musician. For example while shaft-core 18A is preferably made from soft steel or copper that can be bent to a desired shape to optimally accommodate a particular user's hand shape for a comfortable grip, alternatively the invention could be practiced with shaft-core 18A made from hard steel or other rigid material, and could be practiced with or without shaft sleeve 18B.

As an option to the use of spring clip 16 for easy pick removal and replacement, pick 14 could be attached in a more permanent manner to shaft 18, e.g. by screw-type hardware.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A pick assembly for playing a stringed musical instrument, comprising:

a pick, having first and second edges converging to a playing tip and having a third edge region opposite the playing tip, designed for deployment by a player holding said pick between the thumb and forefinger;

an attachment portion made and arranged to attach to said pick in the third edge region;

a shaft portion having a first end attached to said attachment portion and extending therefrom along a longitudinal axis of the third edge region to a second and opposite end; and a generally cylindrical handle portion attached to the opposite end of the shaft portion, made and arranged to be comfortably handheld between palm and fingers, other than the forefinger, of the player:

said shaft portion being made and arranged to couple effective mass to said pick from a hand, wrist and arm of the player, regardless of any longitudinal tensile or compressive force received by said shaft portion.

2. The pick assembly as defined in claim 1 wherein said attachment portion is made and arranged to attach to said pick in a removable manner, such that said pick can be selected from a group of commonly available picks.

3. The pick assembly as defined in claim 2 wherein said attachment portion comprises a metal spring clip securely attached to the first end of said shaft portion and configured with a pair of plates made and arranged to clamp onto the third edge region in a manner to retain said pick frictionally between the pair of plates under spring tension.

4. The pick assembly as defined in claim 2 wherein said tubular handle-sleeve comprises:

a tubular inner handle-sleeve portion made from relatively solid plastic material; and a tubular outer handle-sleeve portion made from foam plastic material, closely surrounding said inner handle-sleeve portion.

5. The pick assembly as defined in claim 4 wherein said handle-core is configured with a central threaded bore by which said shaft portion is threadedly attached to said handle-core.

6. The pick assembly as defined in claim 4 wherein said handle portion further comprises:

a machine screw, engaging the central threaded bore of said handle-core, having a head portion thereby retaining said handle-sleeve to said handle-core.

7. The pick assembly as defined in claim 1 wherein said shaft portion is made from a relatively soft metal such that the player can bend and reshape said shaft portion as desired.

8. The pick assembly as defined in claim 1 wherein said shaft portion comprises a metallic shaft-core portion of circular cross-sectional shape, surrounded by a tubular close-fitting non-metallic sleeve.

9. The pick assembly as defined in claim 1 wherein said handle portion comprises:

a cylindrical handle-core made from metal material; and a tubular handle-sleeve of non-metallic material closely surrounding the handle-core portion.

* * * * *